US007140389B2

(12) United States Patent
Schnatterer et al.

(10) Patent No.: US 7,140,389 B2
(45) Date of Patent: Nov. 28, 2006

(54) VACUUM PRODUCING DEVICE

(75) Inventors: Jürgen Schnatterer, Wolfschlugen (DE); Günter Gebauer, Esslingen (DE)

(73) Assignee: Festo AG & Co., Esslingen (DE)

( * ) Notice: Subject to any disclaimer, the term of this patent is extended or adjusted under 35 U.S.C. 154(b) by 1047 days.

(21) Appl. No.: 10/070,454

(22) PCT Filed: Jun. 21, 2001

(86) PCT No.: PCT/EP01/06997

§ 371 (c)(1),
(2), (4) Date: Mar. 6, 2002

(87) PCT Pub. No.: WO02/04817

PCT Pub. Date: Jan. 17, 2002

(65) Prior Publication Data

US 2002/0144739 A1 Oct. 10, 2002

(30) Foreign Application Priority Data

Jul. 7, 2000 (DE) ..... 100 33 212

(51) Int. Cl.
*E03B 5/00* (2006.01)

(52) U.S. Cl. ..... 137/565.23; 137/832; 137/907; 417/187; 294/64.2

(58) Field of Classification Search ..... 137/832, 137/907, 565.23; 417/187; 294/64.2
See application file for complete search history.

(56) References Cited

U.S. PATENT DOCUMENTS 5,188,411 A * 2/1993 Golden ..... 294/64.2
6,719,536 B1 * 4/2004 Schmalz et al. ..... 417/187

FOREIGN PATENT DOCUMENTS

| | | |
|---|---|---|
| DE | 29903330 U1 | 8/1999 |
| DE | 19808548 A1 | 9/1999 |
| EP | 0540 488 A1 | 5/1993 |
| JP | 61055400 | 3/1986 |
| JP | 06185499 | 1/1991 |

* cited by examiner

*Primary Examiner*—A. Michael Chambers
(74) *Attorney, Agent, or Firm*—Hoffmann & Baron, LLP

(57) ABSTRACT

A vacuum producing device (1) possessing a principal suction nozzle unit (2) with a shut off valve (27) on the upstream side thereof and an additional suction nozzle unit (3) connected in parallel to the principal suction nozzle unit (2). While the supply of pressure medium for the principal suction nozzle unit (2) is controlled in a manner dependent on the negative pressure produced by controlling the shut off valve (27), the additional suction nozzle unit (3) remains (3) constantly in operation. This means that a complete build up of vacuum may be ensured in conjunction with a complete switching off of the principal suction nozzle unit (2) together with a resulting air economizing effect.

13 Claims, 3 Drawing Sheets

VACUUM PRODUCING DEVICE

The invention relates to a vacuum producing device comprising a principal suction nozzle unit able to be supplied by way of principal inflow duct with a pressure medium subject to a predetermined operating pressure, said pressure medium causing a suction effect, on flowing through the principal suction nozzle unit, in a principal suction duct adjoining a principal suction opening, said principal suction duct being connected or being able to be connected with a space to be evacuated, a shut-off valve being provided on the principal supply duct, said valve being able to be actuated in accordance with the negative pressure obtaining instantaneously in the space to be evacuated, said valve being adapted to cause an interruption of the pressure medium supply for the principal suction nozzle unit on a predetermined target negative pressure being reached.

A vacuum producing device of this type is disclosed in the German utility model 29,903,330. Same is for instance utilized in the materials handling art in order to move workpieces or other objects without danger of damage. In this case one or more suction cups, which respectively delimit a space to be evacuated, are connected with the principal suction duct and are able to be positioned on an object to be shifted, a sucking effect leading to a vacuum which provides a negative pressure-dependent holding of the object to be shifted at the respective suction cup. In order to prevent wastage of the pressure medium, which will normally be compressed air, the vacuum producing device is provided with an air economy means intended to interrupt the supply of compressed air, when the desired negative pressure is reached in the space to be evacuated. If the volume to be evacuated is relatively small, the desired effect will in fact be attained. If on the contrary the volume to be evacuated is relatively large, and consequently there will be only a slow build up of the negative pressure, this may, in conjunction with slowly closing shut off valve and the friction forces occurring in the valve in the valve, mean that the rate of flow of supply to the principal suction nozzle unit is reduced to such a degree that the desired build up of negative pressure is no longer possible. The system will then hunt or oscillate till it reaches a condition, in which negative pressure obtaining in the space to be evacuated is less than the desired target negative pressure. Accordingly the suction effect will be impaired and owing to the shut off valve which is never completely closed, there will be a constant wastage of air to certain extent.

One object of the present invention is to provide a vacuum producing device of the type initially mentioned, with which the desired target negative pressure may be reliably reached on the basis of more effective economy measures for the pressure medium.

In order to attain this object the invention provides an additional suction nozzle unit, connected in parallel functionally with the principal suction nozzle unit, such additional unit being constantly supplied during operation of the device with pressure medium subject to an operating pressure and such additional unit possesses an additional suction opening connected fluidwise with the principal suction duct of the principal suction nozzle unit, a check valve being provided between the two suction openings in the principal suction duct and being adapted to close in the direction of suction able to be caused by the principal suction nozzle unit.

In the case of such a vacuum producing device at the start of the suction operation all suction nozzle units are supplied with pressure medium at a desired operating pressure and in parallelism with each other cause air to be drawn off from the space to be evacuated. In this case the suction effect will be the sum of the suction flow rates of all suction nozzles present. If after a certain time the initially mentioned condition is established, in the case of which by slowly closing the shut off valve the suction effect of the principal suction nozzle unit is restricted, through the additional suction nozzle unit (which is still in operation without any change) there will be an evacuation of remaining air until the desired target negative pressure is reached, such negative pressure being able to completely close the shut off valve. Then a stage will be reached, in the case of which there is no requirement for pressure medium on the part of the principal suction nozzle unit and the overall air requirement of the vacuum producing device is only equal to the pressure medium requirement of the addition suction nozzle unit. Since same only represents a fraction of the original maximum pressure medium requirement, the energy balance of flow of pressure medium will be substantially more favorable than in the prior art despite the constantly maintained flow of pressure medium.

A further advantage of the vacuum producing device of the invention is that as a rule no priming pulse circuit is necessary in order to cut the negative pressure present in the space to be evacuated for the purpose of coming clear of an engaged object. Generally it is sufficient to interrupt the pressure medium supply of the suction nozzle unit so that the space to be evacuated is vented by way of the outflow duct, which communicates with the surroundings, of the additional suction nozzle unit.

If during operation of the device owing to a leak occurring into the evacuated space there is again an undesired loss of vacuum, the resulting increase in pressure will cause opening of the shut off valve so that for a certain time the full suction effect of all suction nozzle units will be available again.

Advantageous developments of the invention will appear from the dependent claims.

It is convenient for the additional suction nozzle unit to be designed for a smaller maximum pressure medium flow rate of the supplied pressure medium than the principal suction nozzle unit. The principal suction nozzle zone is designed for a high flow rate and the additional suction nozzle unit is designed for a lower flow rate, while at the same time having a high vacuum producing effect or performance. Accordingly the economizing effect may be still further optimized.

Leakage into the space to be evacuated can be compensated for with the vacuum producing device by the additional suction nozzle unit as far as its suction performance allows. It is therefore an advantage if the additional suction nozzle unit is so designed that suction flow rate able to be produced by it on application of the operating pressure is of the same order as the leakage rate to be expected in the case of the space to be evacuated.

As a shut off valve it is an advantage to utilize a 2/2 way valve, which has a steady or continuous setting behavior.

The negative pressure signal, which is necessary for the actuation of the shut off valve, is preferably supplied to the same by having an actuating face connected functionally with the valve member of the shut off valve, such face being supplied with the negative pressure obtaining in the evacuated space. For setting the response characteristic of the shut off valve furthermore oppositely acting actuating means are provided, which act on the valve member with an oppositely acting, opposing actuating force caused by the supplied negative pressure. By intentional setting of the opposite actuating force the target negative pressure may be selected which is desired in the space to be evacuated.

The oppositely acting actuating means may include a spring means which produces the oppositely acting actuating force and is preferably adjustable, as for instance a pneumatic spring and/or a mechanical spring means. In the case of a particularly advantageous design the oppositely acting actuating means include an oppositely acting actuating area functionally connected with the valve member of the shut off valve, such area constantly being constantly supplied with the operating pressure present in the principal supply duct. Then the oppositely acting actuating force will depend on the existing operating pressure. By suitably setting the area relationships it is possible to produce such an effect that the target negative pressure level is directly proportionally set by selection of the operating pressure.

It will be clear that it may be convenient for all suction nozzle units to be supplied with the same operating pressure during operation of the device so that a single pressure medium will suffice for supply.

The vacuum producing device may be operated with just one single principal suction nozzle unit in an advantageous manner. However, it is quite possible to have several parallel-connected principal suction nozzles, which may be so connected together that a particularly desired operating characteristic is realized.

In what follows the invention will be explained with reference to the accompanying drawings in detail.

Figure 1:
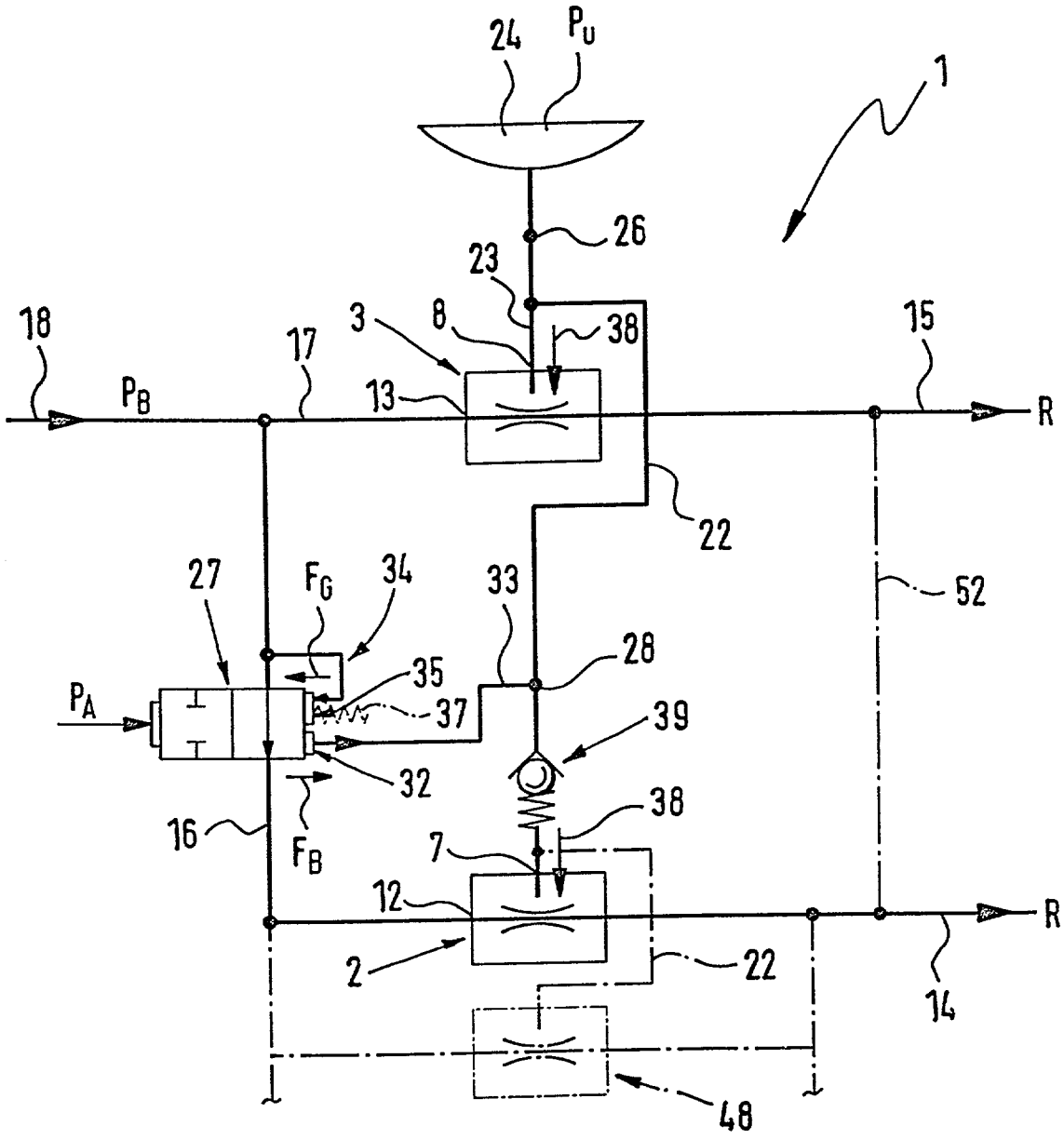
FIG. 1 is a circuit diagram of a preferred embodiment of the vacuum producing device of the invention.
Figure 2:
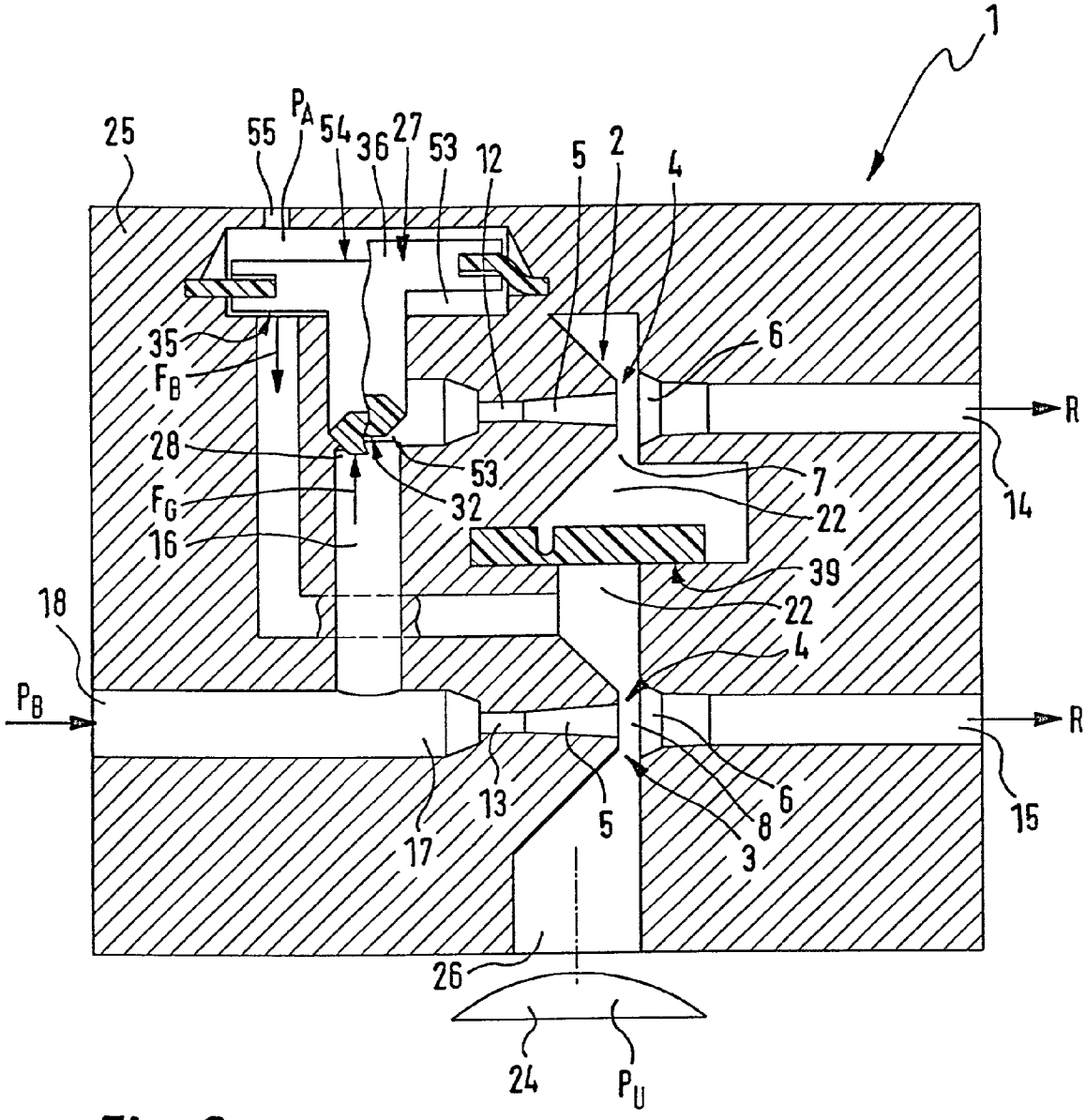
FIG. 2 shows a form of a vacuum producing device realized on the basis of the circuit diagram of FIG. 1.

The vacuum producing device 1 depicted in FIGS. 1 and 2 includes a principal suction nozzle unit 2 and an additional suction nozzle unit 3, the terms "principal" and "additional" also being employed in conjunction with the other components of the vacuum producing device for a better distinction. Moreover, to the extent that the description relates both to the principal suction nozzle unit 2 and also to the additional suction nozzle unit 3, in general the term "suction nozzle unit" will be employed without any such epithet.

The suction nozzle units 2 and 3 have as such a conventional design and possess an ejector means 4 with a jet nozzle duct 5 and a receiver nozzle duct 6 arranged in an axial extension thereof. Between the two above mentioned ducts there is an intermediate space, which is open to one side and which constitutes a suction opening, which for the sake of better distinction in the two suction nozzle units 2 and 3 are termed a principal suction opening 7 and an additional suction opening 8.

Each suction nozzle unit 2 and 3 possesses a principal and an additional supply flow opening 12 and 13, which defines the inlet of a respective jet nozzle duct 5. Adjoining the receiver nozzle 6 there is a principal and, respectively, additional outflow duct 14 and 15 communicating with the atmosphere R.

The principal inflow opening 12 is preceded by a principal inflow duct 16, which leads to a supply opening 18, by way of which a pressure medium, preferably compressed air, at an operating pressure $p_B$, may be supplied. By way of an additional inflow duct 17, which preferably leads to the same supply opening 18, it is also possible for the additional supply opening 13 of the additional suction nozzle unit 3 to be supplied with the respective pressure medium. Here the two additional ducts 16 and 17, as indicated in FIG. 2, may be united for at least a part of their length in order to minimize structural complexity in designing suitable fluid ducts.

If the inflow ducts 16 and 17 were to lead to separate supply openings, it would be possible to set different operating pressures for the two suction nozzle units 2 and 3 in a particularly simple fashion. However, it is preferred to abide by the rule of having the same operating pressure for all suction nozzle units 2 and 3, as is in fact the case in the present working embodiment.

A principal suction duct 22 is connected with the principal suction opening 7 and it leads to the a space 24 to be evacuate d. The space may for instance be the interior space of a suction cup or suction plate as part a vacuum materials handling device, with the aid of which objects are engaged, moved and deposited.

As shown in FIG. 2 the vacuum producing device 1 may comprises A housing 25 which except for the space 24 to be evacuated contains all components of the device, the principal suction duct 22 leading to a connection opening 26 located on the outer face of the housing 25, such connection opening 26 being able to be connected with ducts or fluid lines leading to a component defining the space 24 to be evacuated.

The additional suction opening 8 of the additional suction nozzle unit 3 is also connected with the suction duct 22. In the case of the design illustrated in FIG. 2 this occurs because the additional suction opening 8 is placed directly at some point along the principal suction duct 22. It would be readily possible however to have a connection by way of a suitable additional suction duct 23, as is indicated in the circuit diagram of FIG. 1. However then both suction openings 7 and 8 are simultaneously connected with the space 24 to be evacuated, the ducts employed here being at least partly in the form of a single component if desired.

A shut off valve 27, preferably in the form of a 2/2 way valve is placed on the principal inflow duct 16, said valve being operated in a manner dependent on the instantaneous value of the negative pressure $p_U$ then obtaining in the principal suction duct 22 and accordingly in the space 24 to be evacuated. Normally it will assume the closed setting indicated in FIG. 1, in the case of which it permits unrestricted supply of the pressure medium to the principal suction nozzle unit 2. Once it is switched over into the closed position the passage through the principal inflow duct 16 is shut off and the supply of pressure medium to the principal suction nozzle unit 2 is interrupted. The control of the current position of the shut off valve 27 is performed without electrical means directly by the negative pressure $p_U$ currently obtaining in the space 24 to be evacuated, such pressure being tapped at a tapping point 28 from the principal suction duct 22 and being supplied as a fluid pressure signal to an actuating area 33 of the shut off valve 27. For this purpose a supply duct 33 extending between the tapping point 28 and the actuating area 32 can be provided given a suitable design, as is in fact indicated in FIG. 1. In the case of the design of FIG. 2 the supply duct 33 is dispensed with, since the tapping point 28 is in this case directly on the principal suction duct 22, because the actuating area 32 is in the form of a moving wall section of the principal suction duct 22.

The home position of the shut off valve 27, which is the open position, is defined by oppositely acting actuating means 34. While the negative pressure $p_U$ obtaining in the principal inflow duct 16 is exerting an actuating force $F_B$ in the closing direction of the shut off valve 27 on the actuating area 32, the oppositely acting actuating means 34 are responsible for an oppositely acting actuating force $F_G$ in the opposite direction to the actuating force $F_B$, such force $F_G$ acting in the opening direction.

In the working embodiment the oppositely acting actuating force $F_G$ is caused by the operating pressure $p_B$ acting on the oppositely acting actuating area 35 of the shut off valve 27. In this case both the actuating area 32 and also the oppositely acting actuating area 35 are preferably functionally connected with a valve member 36 of the shut off valve 27 and are preferably mounted directly on the valve member 36.

Since the oppositely acting actuating area 35 is constantly subject to the operating pressure $p_B$, there will be an oppositely acting actuating force $F_G$ urging the valve member 36 constantly toward the open position. The setting force actually switching over the valve member 36 is a result of the resultant force of the oppositely acting actuating force $F_G$ and the actuating force $F_B$ derived from the currently obtaining negative pressure $p_U$. Here the switching characteristic of the of the shut off valve 27 may be influenced by suitable selection of the ratio between the actuating area 32 and the oppositely acting actuating 35. Accordingly again an effect may be produced on that vacuum level—termed the target negative pressure $p_{US}$—at which the shut off valve 27 or, respectively, its valve member 36 assume the closing or shut off position interrupting the supply of pressure to the principal suction nozzle unit 2.

Since in the working example the oppositely acting actuating force $F_G$ is dependent on the level of the operating pressure $p_B$ there is the advantageous possibility or being able to set the desired target negative pressure by selection of the operating pressure $p_b$ at a selected arbitrary level. In this case by a suitable selection of the area ratios it is possible to have a level of the negative pressure or, respectively, vacuum proportional to the input operating pressure.

As an alternative the oppositely acting actuating means for producing the oppositely acting actuating force could also include a spring means 37 as indicated in chained lines in FIG. 1, as for instance a pneumatic spring or a mechanical spring means, the spring force being preferably adjustable in order to be able to set the oppositely acting actuating force and accordingly the desired target negative pressure as may be required.

A preferred manner of operation of the vacuum producing device will now be described in the following.

Firstly by suitable positioning on an object to be handled care is taken to ensure the space 24 to be evacuated is peripherally closed and contains a certain volume of air.

After this pressure medium, preferably compressed air, at an operating pressure $p_B$ is then supplied by way of the supply opening 18 and may initially flow unimpeded to the inflow openings 12 and 13 of the two suction nozzle units 2 and 3 and flows through the latter, it being blasted off into the surroundings R by way of the outflow ducts 14 and 15.

On flowing through the suction nozzle units 2 and 3 a suction effect will be produced at the suction openings 7 and 8, which in turn causes air to be drawn off from the ducts adjoining the suction openings 7 and 8 and from the space 24 to be evacuated. The suction directions 38 are indicated in FIG. 1 by arrows.

If the volume to be evacuated is relatively small, the target negative pressure $p_{US}$ will be produced suddenly and at once will cause closing of the shut off valve 27. Accordingly the principal suction nozzle unit 2 is deprived of any function and now only the additional suction nozzle unit 3 will be operational. Since its maximum pressure medium flow rate is restricted due to design limitations, there will all in all be a reduction of the pressure medium requirement, something rendering possible a more economic operation of the vacuum producing device 1.

If the volume to be evacuated is relatively large, the target negative pressure $p_{US}$ will be established slowly at first in the space 24 to be evacuated. Accordingly there will be a continuous increase in the actuating force $F_B$, which will shift the shut off valve 27, which is has a steady or continuous setting characteristic, or, respectively, its valve member 36 quite slowly toward the closed position. This leads to a slow reduction in the flow through rate permitted by the shut off valve 27 so that even before complete shut off a reduced flow will be established, which considerably reduces the suction effect of the principal suction nozzle unit 2. Without the additional suction nozzle unit 3 this suction effect would be unable to produce the desired target negative pressure $p_{US}$. This would be accompanied by an air requirement at a comparatively high level at the same time.

Since however the additional suction nozzle unit 3 is continuously and constantly in operation without being affected by the setting of the shut off valve 27, it will ultimately ensure that the target negative pressure is produced, which then causes the complete closure of the shut off valve 27. As a consequence the principal suction nozzle unit 2 will be completely shut down and the air requirement will again be dependent the geometrical parameters of the additional suction nozzle unit 3 functionally connected in parallel with the principal suction nozzle unit 2.

In order to ensure that the space 24 to be evacuated is not evacuated when the principal suction nozzle unit 2 is not supplied with pressure medium, by way of its principal outflow duct 14, a check valve 39 is placed on the principal suction duct 22 in the part thereof lying between the two suction openings 7 and 8. As shown in FIG. 2 it may be a flap check valve. It is so designed that it will prevent fluid flow opposite to the suction direction 38 caused by the principal suction nozzle unit 2 whereas it allows the outflow in the desired manner when the principal suction nozzle unit 2 is operative.

Figure 3:
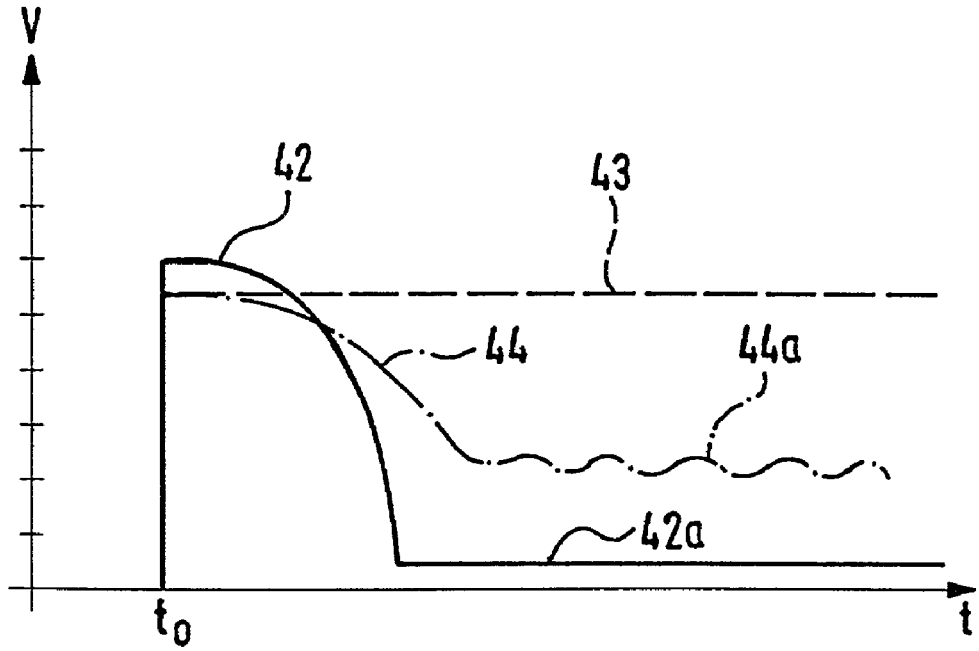
FIG. 3 is a diagram indicating the economizing effect of the vacuum producing device.
Figure 4:
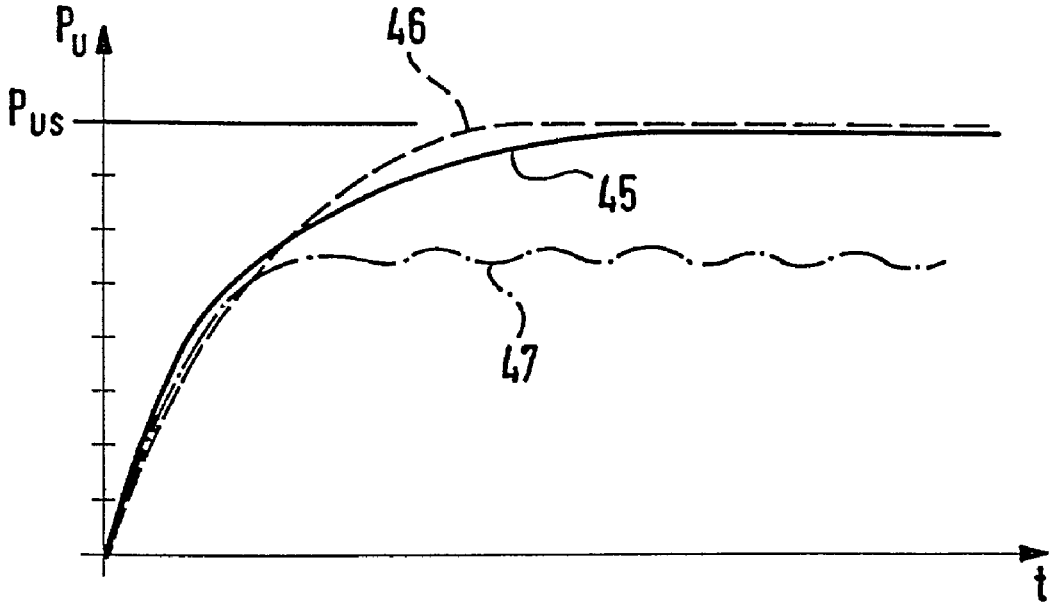
FIG. 4 is a diagram illustrating the build up of pressure in the vacuum producing device as compared with a conventional design.

The potent effect of the pressure medium economizing system resulting from the vacuum producing device 1 will become clear from the diagrams of FIGS. 3 and 4 in conjunction with a high suction effect or performance.

FIG. 3 indicates the through flow rate V of the pressure medium all passing supplied by way of suction nozzle units 2 and 3 by way of the supply opening 18 as related to time, or in other words the fluid requirement V as plotted against time t. The flow rate of the vacuum producing device 1 in accordance with the invention is plotted as the full line at 42. Accordingly at the time t0 of switching on the device there will be a maximum flow as set by the sum of the rates of flow through the two suction nozzles 2 and 3, which then falls slowly in accordance with the reduction in the flow cross section set by the shut off valve 27, until finally the curve section 42*a* with minimum volumetric flow is reached, which is dependent of the operation alone of the additional suction nozzle unit 3.

For comparison the chain line 43 indicates the substantially higher constant air requirement of a conventional vacuum producing device 1, without any air economy system and only having one suction nozzle unit comparable with the principal suction nozzle unit 2.

Finally the chain line curve 44 denotes the air requirement of a vacuum producing device in accordance with prior art and only having one principal suction nozzle unit 2 following an upstream shut off valve 27 and does not have the additional suction nozzle unit 27 of the invention. The shape of the curve is admittedly similar to that of the invention, but however the minimum air requirement denoted by the curve section 44*a* is substantially greater than in the design in accordance with the invention, even although the additional suction nozzle unit 3 is constantly operative.

FIG. 4 shows the build up of the negative pressure $p_U$ in a manner dependent on the time of operation, the build up of vacuum in the invention being indicated by the full line 45. Clearly there are only slight differences as compared with vacuum build up, indicated by the chained line 46, in a device without any air economizing function. The chained line 47 indicates the build up of vacuum in a device which is similar to the invention but does not have any additional suction nozzle unit, in this case the initial build up of vacuum takes place in a similar fashion, the maximum value being substantially below that of the design in accordance with the invention.

In the case of suction nozzle unit 1 in accordance with the invention there is the further possibility of designing the suction nozzle units 2 and 3 as regards the maximum possible flow rate and the suction effect or performance in a different manner and thus of adaptation to the respective application. More particularly, it is possible for the additional suction nozzle unit 3 to be so designed that on applying the operating pressure the resulting suction flow rate is generally comparable to the leak rate occurring at the space 24 to be evacuated, because for example the respective suction cup does not engage the respective object to be handled absolutely hermetically.

It is furthermore an advantage if, as compared with the principal suction nozzle unit 2, the additional suction nozzle unit 3 is designed for a lesser maximum pressure medium flow rate as regards the supplied pressure medium. Then there is the possibility of designing the principal suction nozzle unit 2 for a high flow rate, this ensuring that a relatively high volume is relatively quickly exhausted. The additional suction nozzle unit 3 on the contrary may be designed for a high vacuum.

All in all the vacuum producing device of the invention may produce an air economy of the order of 90% as compared with a device without an air economizing system.

It would be readily possible to have more than one principal suction nozzle unit as is indicated in chained lines in FIG. 1 at 48. Several such principal suction nozzle units 2 may be connected together in parallel, their suction ducts coming together at a common principal suction duct. It is convenient for the supply of pressure medium for all principal suction nozzle units 2 to be controlled by a single shut off valve 27.

A chained line 52 in FIG. 1 makes it even clearer that the outflow ducts 14 and 15 present may be readily joined together so that venting takes place by way of a common outflow opening.

FIG. 2 shows a particularly advantageous and compact design for the vacuum producing device 1 in the case of which the shut off valve 27 is integrated in the housing 25 having the suction nozzle units 2 and 3 as well. As already indicated in this case the actuating area 32 is constituted by a moving wall section of the principal flow duct 22, it being located on the end side of a piston section of the valve member 36, which may be moved adjustably in the respective socket 53 in the housing 25. Dependent on the position assumed the valve member 36 will project to a greater or lesser extent into the principal suction duct 22 and so set the flow cross section 53 available for the pressure medium. The oppositely acting actuating face 35 is aligned like the actuating face 32 and faces away from the a further actuating face 54 of the valve member 36, which is subject to atmospheric pressure pA by way of a hole 55.

By way of conclusion it may be stated as regards the vacuum producing device 1 that the maximum possible vacuum may be produced despite an economizing system. The characteristics for operational pressure and vacuum are identical with and without the economizing system. The pressure-dependent regulation of the shut off valve, which may be termed an air economizing shut off valve, is virtually static when there is only a low leak rate in the suction ducts and, respectively, in or into the space to be evacuated. This leads to low wear.

The invention claimed is:

1. A vacuum producing device comprising:

a principal suction nozzle unit able to be supplied by way of principal inflow duct with a pressure medium subject to a predetermined operating pressure, said pressure medium causing a suction effect, on flowing through the principal suction nozzle unit, in a principal suction duct adjoining a principal suction opening, said principal suction duct being connectable with a space to be evacuated, a shut-off valve being provided on the principal supply duct, said valve being actuatable in accordance with the negative pressure obtaining instantaneously in the space to be evacuated, said shut-off valve preventing flow of the pressure medium supply through the shut-off valve thereby interrupting the pressure medium supply to the principal suction nozzle unit when a predetermined target negative pressure is reached, wherein an additional suction nozzle unit is provided and connected in parallel functionally with the principal suction nozzle unit, such additional unit being constantly supplied during operation of the device with pressure medium subject to an operating pressure and such additional unit possessing an additional suction opening connected fluidwise with the principal suction duct of the principal suction nozzle unit, a check valve being provided between the two suction openings on the principal suction duct and being adapted to close oppositely to the direction of suction able to be caused by the principal suction nozzle unit.

2. The vacuum producing device as set forth in claim 1, characterized in that the additional suction nozzle unit is designed for a maximum pressure medium flow rate less than that of the principal suction nozzle unit, of the supplied pressure medium.

3. The vacuum producing device as set forth in claim 1, characterized in that the additional suction nozzle unit is so designed that the suction flow rate able to be produced by it is of the same order as the leak rate in the case of the space to be evacuated.

4. The vacuum producing device as set forth in claim 1, characterized in that the shut off valve is in the form of a 2/2 way value.

5. The vacuum producing device as set forth in claim 1, characterized in that for operation of the shut off valve the negative pressure obtaining in the space to be evacuated is switched constantly to an actuating area constantly functionally connected with the valve member of the shut off valve, oppositely acting actuating means being provided, which as regards the valve member cause an oppositely acting force ($F_G$) in a direction opposite to the actuating force $F_B$ caused by switched negative pressure.

6. The vacuum producing device as set forth in claim 5, characterized in that the oppositely acting actuating means include a spring means causing the oppositely acting actuating force $F_G$, such spring means preferably being adjustable.

7. The vacuum providing device as set forth in claim 5, characterized in that the oppositely actuating means include an oppositely acting actuating area functionally connected with the-valve member of the shut off valve, such area constantly having the operating pressure switched to it, which is present at the principal inflow duct.

8. The vacuum producing device as set forth in claim 7, characterized in that the ration between the actuating area and the oppositely acting actuating area is so selected that the vacuum able to be produced inside the space to be evacuated is proportional to the operating pressure applied at the principal inflow duct.

9. The vacuum producing device as set forth in claim 5, characterized in that the actuating area is constituted by a moving wall section of the principal inflow duct and preferably is provided on an end face of the valve member.

10. The vacuum producing device as set forth claim 1, characterized in that all suction nozzle units are supplied in operation of the device with a pressure medium subject to the same pressure.

11. The vacuum producing device as set forth in claim 1, characterized in that several parallel connected principal suction nozzle units are provided.

12. The vacuum producing device as set forth in claim 1, characterized by a shut off valve having a steady setting behavior.

13. The vacuum producing device as set forth in claim 1, wherein the principal suction nozzle unit has an outflow duct which connects directly to atmosphere, and the additional suction nozzle unit has an outflow duct which connects directly to atmosphere.

* * * * *